US007802655B2

(12) United States Patent
de Wet et al.

(10) Patent No.: US 7,802,655 B2
(45) Date of Patent: Sep. 28, 2010

(54) SOLID COMPOSITION STICK APPLICATOR

(75) Inventors: Jonathan de Wet, North Vancouver (CA); Ron C. Y. Hui, Burnaby (CA); Douglas Robert McKay, Burnaby (CA); Zdravko Zdjelar, Coquitlam (CA); Robert J. Harris, Stoke-on-Trent (GB)

(73) Assignee: Kelsan Technologies Corp., North Vancouver (CA)

( * ) Notice: Subject to any disclaimer, the term of this patent is extended or adjusted under 35 U.S.C. 154(b) by 785 days.

(21) Appl. No.: 10/937,581

(22) Filed: Sep. 8, 2004

(65) Prior Publication Data

US 2006/0048999 A1 Mar. 9, 2006

(51) Int. Cl.
*B61K 3/00* (2006.01)

(52) U.S. Cl. ..... 184/3.2; 184/2; 184/3.1

(58) Field of Classification Search ..... 118/208, 118/307; 184/3.1, 3.2, 99; 188/264 B, 252
See application file for complete search history.

(56) References Cited

U.S. PATENT DOCUMENTS

| | | | | |
|---|---|---|---|---|
| 990,637 | A * | 4/1911 | Dawson | 184/3.2 |
| 2,915,753 | A * | 12/1959 | Ruskin | 227/128 |
| 3,027,974 | A | 4/1962 | Allen | |
| 4,811,818 | A | 3/1989 | Jamison | |
| 5,054,582 | A | 10/1991 | Aracil | |
| 5,173,204 | A | 12/1992 | Chiddick et al. | |
| 5,251,724 | A | 10/1993 | Szatkowski et al. | |
| 5,308,516 | A | 5/1994 | Chiddick | |
| 5,337,860 | A | 8/1994 | Burke et al. | |
| 6,136,757 | A | 10/2000 | Chiddick | |
| 6,182,793 | B1 * | 2/2001 | Jamison | 184/3.2 |
| 2003/0101897 | A1 | 6/2003 | Mitrovich et al. | |
| 2004/0238282 | A1 * | 12/2004 | Mitrovich | 184/3.2 |

FOREIGN PATENT DOCUMENTS

| | | |
|---|---|---|
| CA | 320283 | 3/1932 |
| GB | 7953 | 0/1914 |
| GB | 272529 | 8/1927 |

* cited by examiner

*Primary Examiner*—Bradley T King
*Assistant Examiner*—Thomas Irvin
(74) *Attorney, Agent, or Firm*—Merchant & Gould P.C.

(57) ABSTRACT

A solid composition stick applicator is provided. The applicator comprises an applicator body having a first and second end, the second end having an opening through which a solid composition stick is dispensed. Within the applicator is housed a helical tension spring having a first spring end and a second spring end, the first spring end, second spring end, or both the first and second spring end held at a fixed position with respect to the applicator body. The helical tension spring is wound around a guide system that is housed within the applicator body. A pushing assembly is attached to the helical tension spring and the pushing assembly is movable from a first position at or near the first end of the applicator body, to a second position at or near the second end of the applicator body. Tension within the helical tension spring is greater in the first position than in the second position thereby urging the pushing assembly towards the second end of the applicator body. The use of a helical tension spring within the applicator greatly increases the life of the applicator under field conditions.

11 Claims, 13 Drawing Sheets

SOLID COMPOSITION STICK APPLICATOR

The present invention relates to a solid composition stick applicator, more particularly to a solid composition stick applicator having improved performance.

BACKGROUND OF THE INVENTION

Over the last two decades there has been a significant increase in the presence of motorized rail transportation in urban areas resulting in an increasing need for methods of reducing the high frequency sounds which result from the twisting of the axle and sudden subsequent release of the twist as a curved rail is negotiated by the wheels of a train.

Initially, lubrication and noise reduction were addressed by pumping oil under pressure through nozzles directed at the wheel contact point with the track. However, these types of lubricant showed the tendency to creep onto the crown of the rail, which caused unacceptable slippage. This technology also left oil on the track and surrounding area. Due to environmental concerns caused by this oil contamination, solid stick lubricants have increased in popularity and have been useful for reducing friction and otherwise varying the frictional characteristics of steel to steel contact between train wheels and railway tracks. Additionally, solid lubricants have improved the accuracy and effectiveness of the delivery of lubricant to the flange. In a typical application, a stick lubricant is applied by a holding means to the wheel flange and/or tread of a train.

Solid lubricants are known in the art and generally comprise a solid lubricant in combination with other components. The type and amount of the components in the solid lubricant stick may vary depending on the characteristics desired, for example increased or decreased friction. Solid lubricant sticks, or composition sticks, are described, for example, in U.S. Pat. Nos. 5,173,204; 5,308,516; and 6,136,757 (which are incorporated herein by reference).

Applicators generally comprise a holding means to retain the lubricant or composition stick in position, and contain a pushing mechanism for maintaining the composition stick in contact with the wheel. Applicators are generally used in system where steel-to steel contact may occur, for example, on the underside of a locomotive or rail car, or along any rail system, for example rails in an elevator shaft, where space is at a premium. Therefore, it is desired that the applicator requires as little space as necessary, may easily be reloaded with new lubricant sticks, and is reliable.

U.S. Pat. No. 4,811,818 (Jamison) describes an applicator in which a lubricant, or composition stick, is held in place by a stud mounted on a bracket. The bracket is biased by a torsion spring such that the stick is in contact with the wheel. However, the lubricant or composition stick in Jamison is exposed to dust, dirt and oil present in the environment of the locomotive underside, which affects its performance. Furthermore, in this system, lubricant or composition stick manufacture is complex, as a stud, or a recessed nut, must be inset into the upper end of the stick for attachment to the applicator. Replacement of the stick therefore is complex.

U.S. Pat. No. 5,054,582 (Aracil) discloses a solid stick applicator having a biased pusher arm, which applies pressure to the stick as the arm progresses through an arcuate path. The pusher arm enters the applicator body through a slit that also functions as a register to align the pusher against the composition stick, and the spring assembly is exposed. This mechanism is easily jammed with contamination and debris during use, is difficult to maintain, and is subject to premature wear.

Another composition stick applicator is taught in U.S. Pat. No. 5,251,724 (Szatkowski et al), in which the applicator has a pair of coiled flat springs (i.e. constant force springs; CFS) that exert a constant forward force on the lubricant or composition stick such that it is urged forward out of the applicator and against a steel surface, for example a wheel flange. Retraction of the spring assembly to the rear allows insertion of a replacement stick through a cutout on the side of the applicator. A similar applicator comprising coiled flat springs is described by in U.S. Pat. No. 5,337,860 (Burke et al.). While the '724 and '860 applicators require less space when replacing the lubricant, the cutout results in significant contamination of the stick and the applicator and jamming may occur. Furthermore, the coiled flat springs tend to fail prematurely, resulting in increased maintenance.

Mitrovich et al. (U.S. 2003 0,101,897) teaches a composition stick applicator having a holder into which a dispensing insert is placed. The dispensing insert includes a slide mechanism onto which is attached a coiled flat constant force spring (CFS). A lubricant or composition stick is placed in the holder, and the dispensing system is inserted into the holder behind the lubricant stick. The stick thus extends the CFS such that the coiled portion of the spring pushes the stick out of the applicator onto the desired surface. While this design permits easy removal and cleaning of the holder to minimize debris build up, during regular use and reloading, the solid stick translates back and forth causing bending stresses within the coiled flat CFS. As noted above with reference to U.S. Pat. Nos. 5,251,724 and 5,337,860, these cyclical stresses cause the CFS to quickly develop fatigue cracks, resulting in short spring life. Frequent spring replacement is required for proper function of the lubrication system.

SUMMARY OF THE INVENTION

The present invention relates to a solid composition stick applicator, more particularly to a solid composition stick applicator having improved performance.

It is an object of the present invention to provide a solid composition stick applicator.

The present invention provides a solid composition stick applicator comprising, a) an applicator body having a first and second end, the second end comprising an opening through which a solid composition stick is dispensed;

b) a helical tension spring having a first spring end and a second spring end, the first spring end, the second spring end, or both the first and the second spring end held at a fixed position with respect to the applicator body;

c) a guide system within the applicator body and around which the helical tension spring is passed; and d) a pushing assembly attached to the helical tension spring and movable from a first position proximate the first end of the applicator body, to a second position proximate the second end of the applicator body, where tension within the helical tension spring is greater in the first position than in the second position thereby urging the pushing assembly towards the second end of the applicator body.

The present invention also provides the solid composition stick applicator as just defined, wherein the first end, or a surface of the applicator body near the first end, comprises an opening through which the solid composition stick is inserted. Furthermore, the solid composition stick applicator may also comprise a mount, attached to the applicator body, the mount for attaching the solid composition applicator adjacent a surface to be treated. The mount may be pivotally attached adjacent the surface to be treated.

The helical tension spring within the solid composition stick applicator as defined above may further comprise an extension attached to the first spring end, the second spring end, or both the first and second spring ends.

The present invention also pertains to the solid composition stick applicator as defined above, wherein the helical tension spring, the pushing assembly and the sheave system are part of a dispensing insert that attaches to the applicator body. Furthermore, the dispensing insert may be removeably attached to the applicator body.

The present invention also includes the solid composition stick applicator as defined above, wherein the helical tension spring, the pushing assembly and the sheave system are part of the applicator body.

The present invention also provides a solid composition stick applicator comprising:

a) an applicator body for holding a composition stick, the applicator body having a first end into which the composition stick is inserted and a second end from which the composition stick is dispensed;
b) a mount for attaching the applicator body in proximity of a position to be lubricated; and
c) a dispensing insert for applying pressure to the solid lubricant stick such that it is dispensed from the second end of the applicator body, the dispensing system including:
   i) an insert body;
   ii) a helical tension spring having a first end and a second end, the first end, the second end, or both the first and second end attached to the insert body at a fixed position;
   iii) a pushing assembly attached to the helical tension spring; and
   iv) a guide system around which the helical tension spring is wound to create a force urging the pushing assembly against the solid lubricant stick, which urges the solid lubricant stick against the position to be lubricated.

The present invention further provides a dispensing insert for matingly engaging an applicator body and applying a solid composition stick to a position to be lubricated, the dispensing insert comprising:

a) an insert body;
b) a helical tension spring having a first end and a second end, the first end, the second end, or both the first and the second spring end attached to the insert body at a fixed position;
c) a pushing assembly attached to the helical tension spring; and
d) a guide system around which the helical tension spring is wound to create a force urging the pushing assembly against the solid lubricant stick, which urges the solid lubricant stick against the position to be lubricated, when the dispensing insert is engaged with the applicator body.

The applicator of the present invention provides a substantial increase in insert spring life. A tension spring is run over a sheaving mechanism that causes the spring to have a near constant force (tension) throughout the pushing assembly travel. Using this mechanism the spring has a dramatically increased cyclic life when compared to the life of coiled flat springs, and delivers a near constant force from the front to the rear of the applicator. Furthermore, the applicator is durable and lightweight, and may be used for any application requiring treatment of a surface, including treating wheel surfaces of a locomotive or rail car, elevator rails or wheel assemblies, fifth-wheels and the like. The Applicator may be easily reloaded with a composition stick, in a process that does not require tools, and reducing the space envelope around the applicator. With standard applicators twice the length of the applicator is required for either composition stick insertion, or insert removal and loading with a composition stick. In an embodiment of the present invention, no insert is required and the composition sticks can be side loaded, or rear loaded. Side loading allows for a longer applicator capable of housing a longer composition stick resulting in a longer service interval.

This summary of the invention does not necessarily describe all necessary features of the invention.

BRIEF DESCRIPTION OF THE DRAWINGS

These and other features of the invention will become more apparent from the following description in which reference is made to the appended drawings wherein:

FIG. 1 shows schematics of a prior art applicator.

FIG. 2 shows various components of several applicators of the present invention.

FIG. 3 shows features of several applicators of the present invention.

FIG. 4 shows an alternate applicator. In FIG. 4*b*, the helical spring is in a retracted position.

FIG. 5 shows a schematic of several apparatus used to test the applicators comprising constant force springs or helical tension springs.

DESCRIPTION OF PREFERRED EMBODIMENT

Figure 1A:
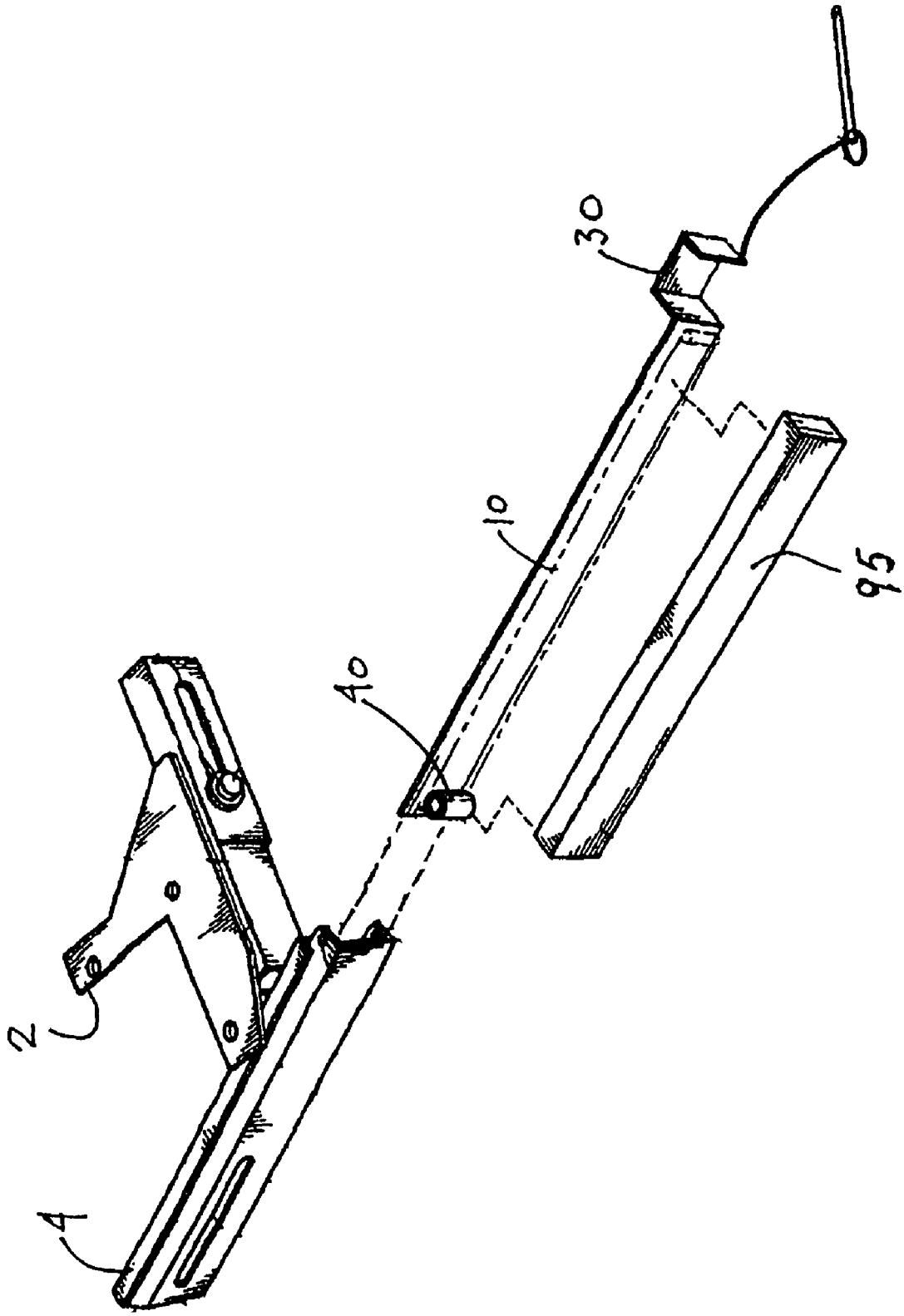
Figure 1A Prior Art
FIG. 1*a* shows an exploded view of a prior art applicator comprising an insert 10, body 4, mount 2 and composition stick 95.

The present invention relates to a solid composition stick applicator, more particularly to a solid composition stick applicator having improved performance.

The following description is of a preferred embodiment by way of example only and without limitation to the combination of features necessary for carrying the invention into effect.

The solid composition stick applicator of the present invention is designed to apply a solid composition to a surface in steel-to-steel contact. For example, but without wishing to be limiting, the applicator may be used to apply solid composition to the flange of a wheel of a locomotive or rail car, a rail in a closed system for example an elevator rail, or other steel surfaces in sliding contact, for example fifth wheels.

The solid composition stick applicator of the present invention provides substantially longer spring life, minimizing applicator maintenance, compared to prior art applicators. The present invention does not make use of a constant force spring (CFS) to generate solid lubricant stick application force, but rather utilizes a helical tension spring in conjunction with a pulley system. This configuration has been found to provide a near constant force in maintaining pressure on the composition stick against the surface to which it is being applied, and exhibit significant increase in spring life over the CFS of the prior art. Furthermore, the biasing system of the present invention may be used within an application holder as described herein, or as an insert within prior art applicators, for example but not limited to that of U.S. 2003 0,101,897 (which is incorporated herein by reference). The solid compositions stick may be comprised of any desired substance to be applied to surface, for example, but not limited to the compositions as defined in U.S. Pat. No. 5,173,204 or U.S. Pat. No. 5,308,516 (which are incorporated herein by reference).

In one aspect, the solid composition stick applicator of the present invention comprises:

a) an applicator body having a location at or near a first end into which the solid composition stick is inserted and a second end from which the solid lubricant stick is dispensed;

b) a mount for attaching the applicator body;

c) a helical tension spring having a first spring end and a second spring end, the first spring end, the second spring end, or both the first spring end and the second spring end, held at a fixed position with respect to the applicator body;

d) a pushing assembly attached to the helical tension spring or to an extension of the helical tension spring attached to the helical tension spring; and e) a guide system around which the helical tension spring, the extension of the helical tension spring, or both, is wound to create a force urging the pushing assembly along the applicator body towards the second end of the applicator body.

The present invention is also directed to a dispensing insert that matingly engages an applicator body and for applying a solid composition stick to a position to be lubricated, the dispensing insert comprising:

a) an insert body;

b) a helical tension spring having a first end and a second end, the first end, the second end, or both the first and the second end attached to the insert body at a fixed position;

c) a pushing assembly attached to the the helical tension spring, or to an extension of the helical tension spring attached to the helical spring, and slidably mounted to the insert body; and d) a guide system around which the helical tension spring, an extension of the helical tension spring, or both, is wound to create a force urging and sliding the pushing assembly within the insert body.

The dispensing insert 10 of the present invention may be adapted to fit into a prior art applicator body that is already mounted adjacent a surface to be lubricated. For example, but without wishing to be limiting, the insert may be configured to fit into the combination holder-dispenser disclosed in U.S. Publication No. 2003/0,101,897. In this case, only the dispensing insert need be purchased, reducing the expense incurred with adopting a new lubrication system.

With reference to FIG. 1*a* there is shown a prior art applicator assembly (U.S. 2003/0101897; which is incorporated herein by reference) comprising an applicator body 4, a mount 2, a dispensing insert 10 that receives a composition stick 95 and a constant force helical spring (CFS; 40) to urge the composition stick out of the applicator assembly and against a surface to be treated. Applicator assemblies that do not comprise an insert, and where the constant force spring is located within the applicator body, or that operates in conjunction with the applicator body, are also known (e.g. U.S. Pat. Nos. 5,251,724; 5,337,860; 5,251,724 4,811,818; 5,054,582), and are to be included within the scope of the present invention (for example FIGS. 4*a* and 4*b*).

Figure 1B:
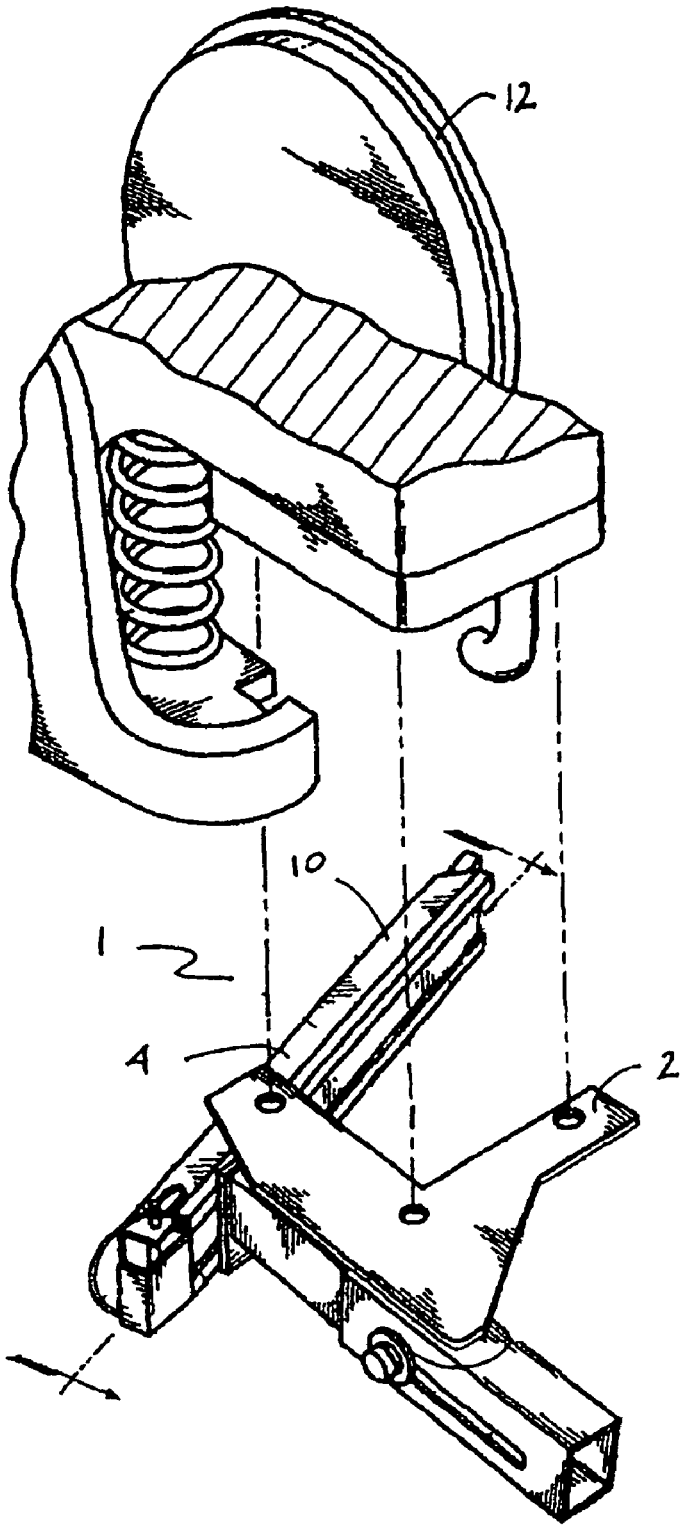
Figure 1B Prior Art
FIG. 1*b* shows the general mounting of the applicator adjacent to a steel surface to be treated, in this case, a wheel of a locomotive.

The mount 2 is attached in proximity of the surface to be lubricated, for example adjacent a steel surface to be treated, for example but not limited to a wheel flange 12 of a rail car, as shown in FIG. 1*b*. The mount 2 may be of any configuration as would be known in the art allowing attachment. In the case of a rail car, the mount 2 may be adapted to minimize inertial loads, as disclosed in U.S. Pat. No. 5,251,724 (which is incorporated herein by reference). The applicator body 4 is attached to the mount 2 by means well known in the art. For example, but without wishing to be limiting, the applicator body 4 may be attached to the mount 2 by fasteners such as rivets or screws, or the applicator body 4 may be welded to the mount 2.

Figure 2A:
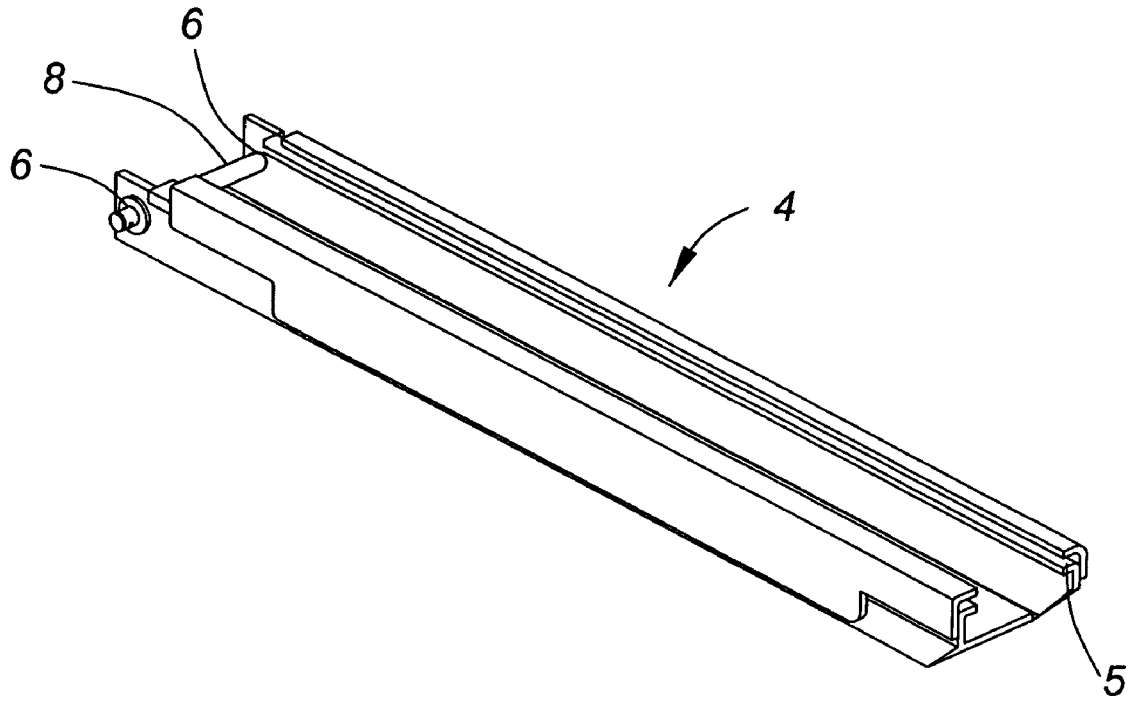
FIG. 2*a* shows a perspective view of an example of an applicator body 4.
Figure 2B:
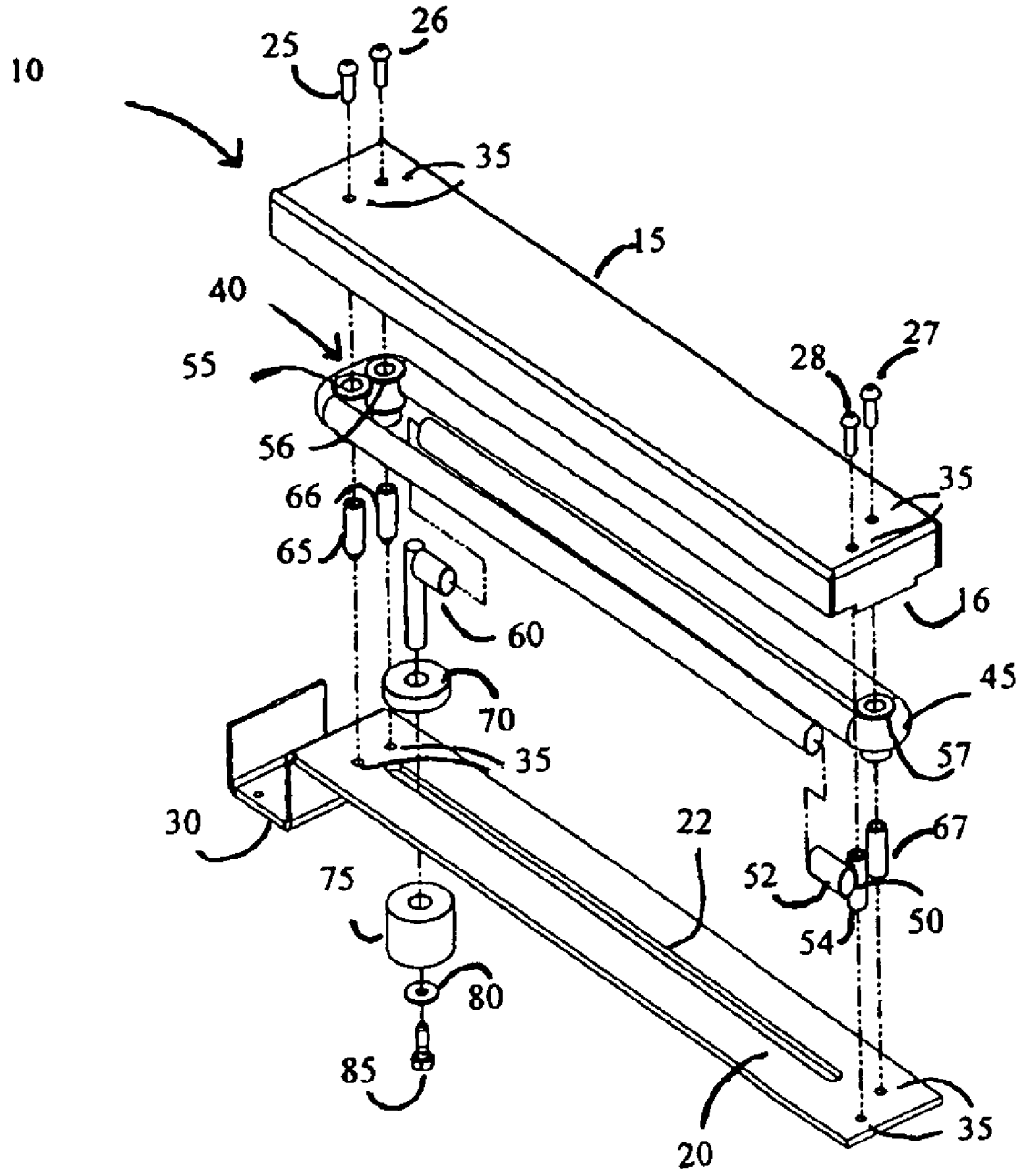
FIG. 2*b* shows an exploded view of components of an example of a dispensing insert 10.
Figure 2C:
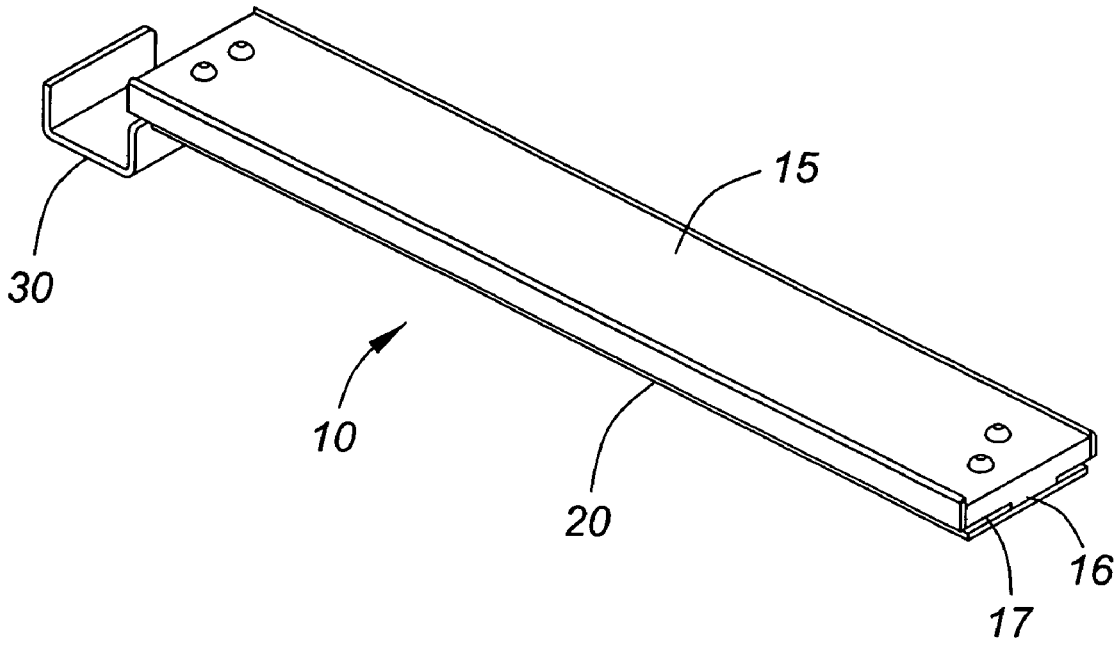
FIG. 2*c* shows a perspective view of an assembled dispensing insert 10.

With reference to FIGS. 2*a-d*, 2*h*, 3*a*, and 3*b*, there is shown a non-limiting example of an applicator comprising an applicator body 4 configured to accept a removable dispensing insert (10; FIGS. 1*a*, 2*c*). However, applicator bodies that are not configured to accept a removable dispensing insert may also be used with the invention as described below. The applicator body 4 may be configured as a three-sided rectangle (C-channel) with open ends. For example, but without wishing to be limiting in any manner, the applicator body 4 may be a formed sheet steel weldment. A receiving means, for example but not limited to a longitudinal groove 5 is adjacent to both sides of the open side of the rectangular applicator body 4, may be providing for dispensing insert 10 placement. The dispensing insert 10 may also be introduced and retained within the applicator body using other configurations. In the example shown, the applicator body 4 may retain the dispensing insert 10 in position within the applicator body 4 using a combination of the longitudinal groove 5 and a locking device 8, for example but not limited to, a pin, a cotter pin, a lock pin, a bolt and the like. The locking device 8 may comprise a ball-lock pin forced through two concentric holes 6 on either side of the applicator back end.

Figure 2D:
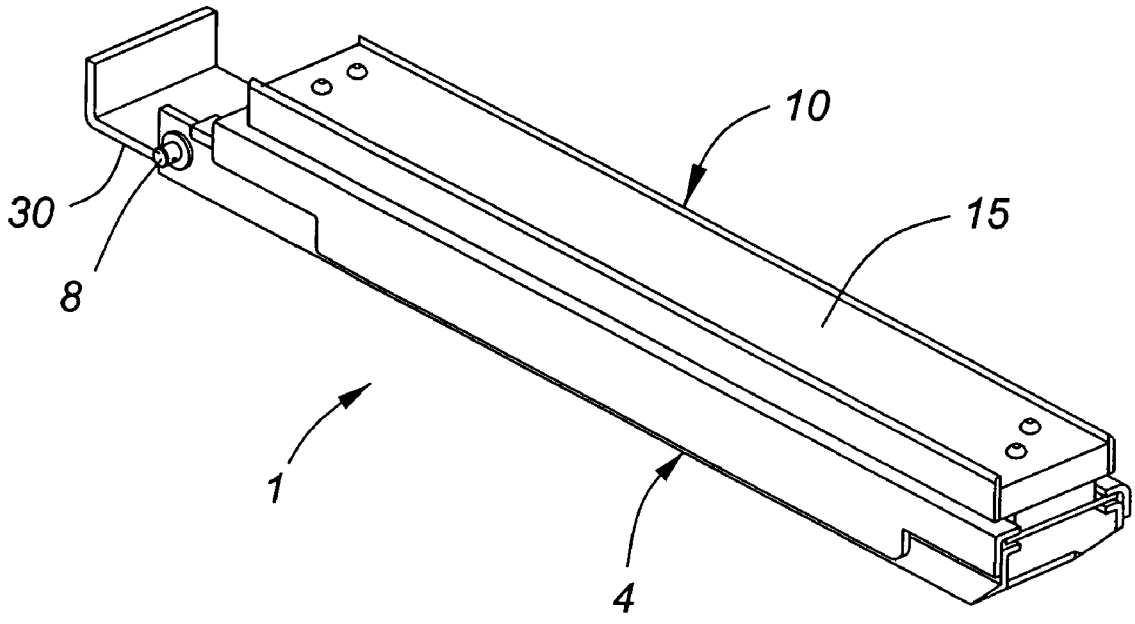
FIG. 2*d* shows a perspective view of an assembled applicator comprising the applicator body 4, and dispensing insert 10.

The dispensing insert 10, generally shown in FIG. 2*c*, may be constructed as shown in FIG. 2*b*, where the insert 10 comprises an insert cover 15 and a mounting plate 20, which are fixed to each other for example by suitable fasteners, including but not limited to rivets, screws, bolts (25-28) that pass though openings 35, or the two surfaces may be snap fit together to form the insert 10 (FIG. 2*c*). When attached, tab 16 ensures that a lip 17 may be formed in the assembled dispensing insert 10, and that may be registered within grooves 5 (FIG. 2*a*), when the insert is fitted onto the applicator body 4 to produce the applicator 1 (FIG. 2*d*). The mounting plate 20 has a longitudinal slot 22 and may comprise a hold 30, for example a U-shape hold, at one end, as shown in FIGS. 2*b-d*. If the insert 10 and the applicator body 4 are of a unitary construction (e.g. FIGS. 4*a* and 4*b*) then the tab (16), lip (17) and groove (5) may not be required.

Figure 2E:
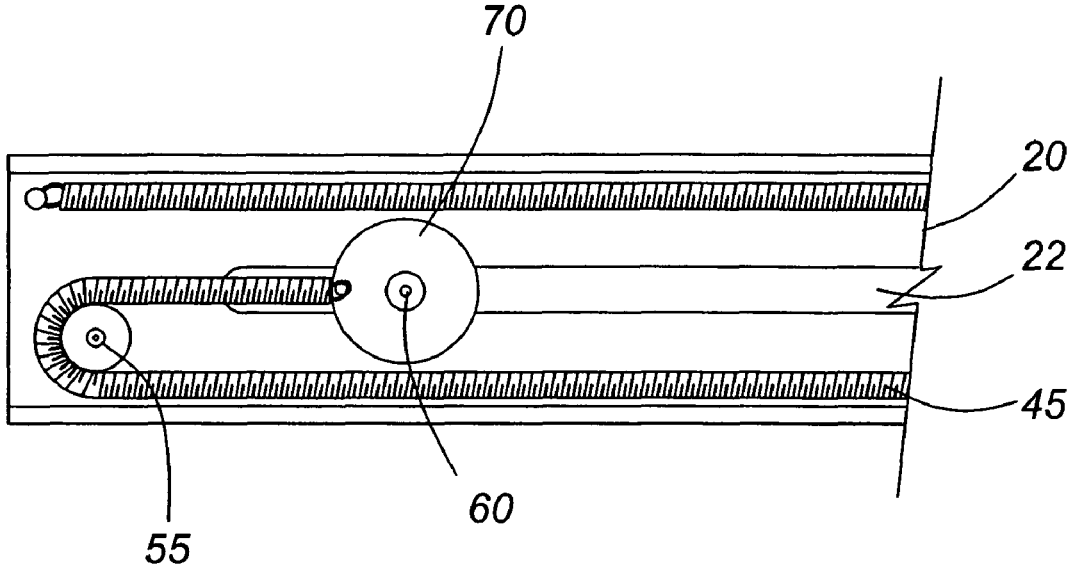
FIG. 2*e* shows a side view of a portion of an alternate top or mounting plate of the present invention.
Figure 2F:
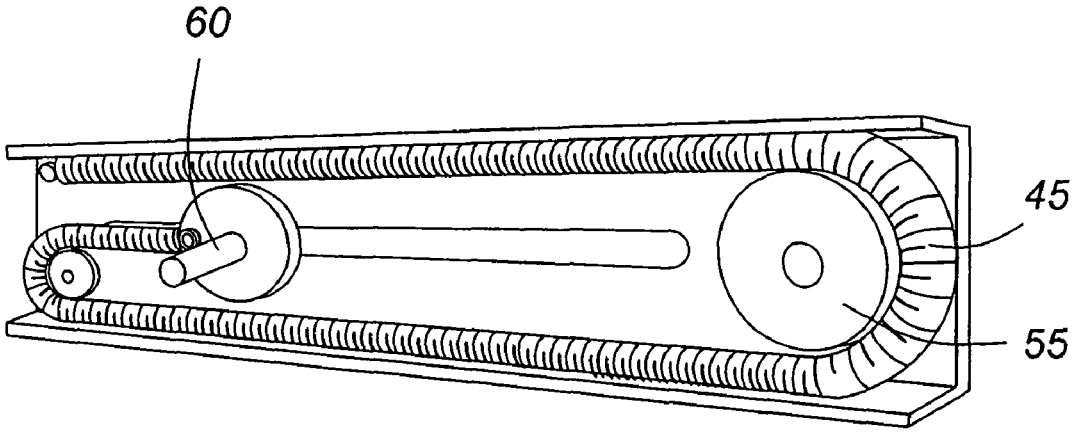
FIG. 2*f* shows a perspective side view of an alternate top plate and associated components.
Figure 2G:
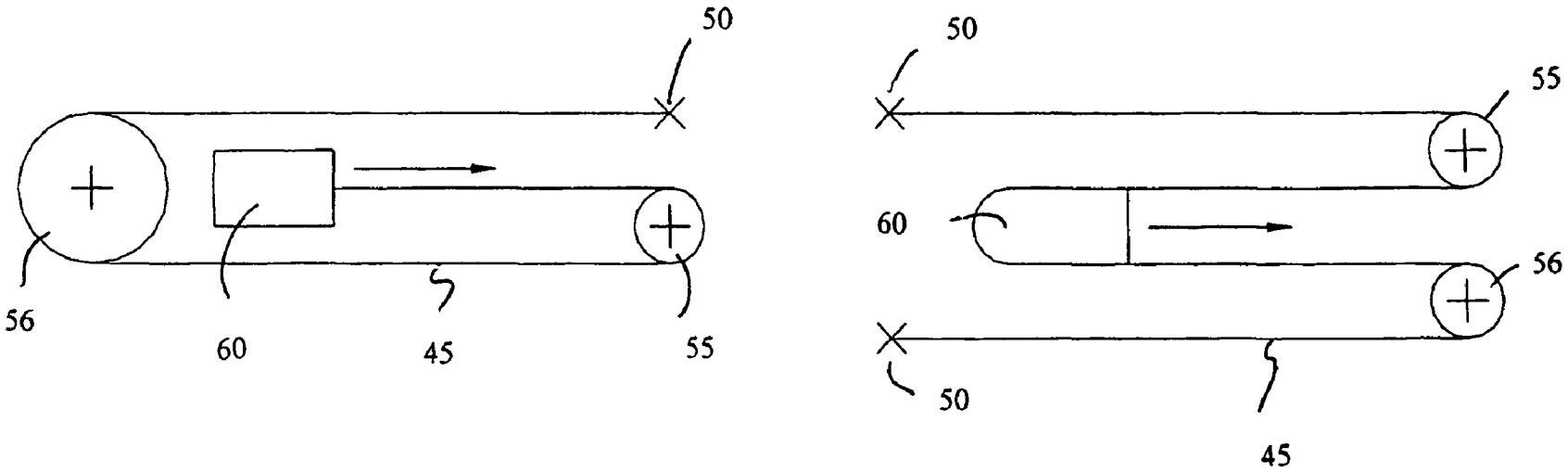
FIG. 2*g* shows a schematic view of various methods for fitting a helical tension spring within an applicator.

The spring mechanism (pushing assembly) 40 is disposed within the cavity of the dispensing insert 10. The spring mechanism 40 comprises a helical tension spring 45 and a guide system, for example guiding blocks having a low coefficient of friction, a sheave system comprising rotatable sheaves (as shown in FIG. 2*b*; 55-57), or other suitable system as would be known to one of skill in the art, about which the helical tension spring is wound. The helical tension spring may be fixed to the dispensing insert or body by a fixed spring anchor 50 fixed to one end (a first spring end), and a floating spring mount 60 attached to the helical tension spring, for example at an end (a second spring end), of the helical tension spring as shown in FIG. 2*b*. However, other methods for attaching the helical tension spring may also be used, for example the first, the second, or both the first and second spring ends may be attached to the dispensing insert or body as shown in FIG. 2*g*. In this example, where the first and second spring ends are attached to the dispensing insert or body, the floating spring mount 60 is located between the first and second ends.

The helical tension spring 45 may be of a unitary construction as shown in FIG. 2*b*, may comprise a plurality of helical tension springs attached in end-to-end fashion and connected end-to-end by eye hooks (see FIGS. 2*e* and 2*f*), or the helical tension spring may comprise a helical tension spring attached to an extension of the helical tension spring. The extension may be any suitable flexible metallic or polymeric cable. The tension spring 45 is of a size and length sufficient to provide a suitable force to push a composition stick 95 out of the applicator 4 (see FIGS. 3*a-b*).

A first end of the spring 45, the second spring end, or both the first and second spring ends, may be fastened to the mounting plate 20 via a fixed spring anchor 50. The fixed spring anchor 50 may be of any configuration amenable to the attachment of the helical spring 45 to the dispensing insert 10 or, in the case where a dispensing insert is not used, the applicator body 4. In a non-limiting example, the fixed spring anchor 50 may comprise a spring end receiver (52, 54, for example as shown in FIG. 2*b*) that is attached to the insert or a body.

The spring 45 is wound around one or more than one guide system, for example sheaves 55-57, or guide blocks having a low coefficient of friction. In the non-limiting example shown in FIG. 2*b*, the guide or sheave system to comprise three sheaves, and in FIG. 2*f*, a sheave system comprising 2 sheaves is shown. However, the guide system may be comprised of multiple sheaves or guide blocks for example but not limited to, 1, 2, 3 or 4 sheaves or guide blocks, arranged in various configurations to redirect the path of the helical spring 45 within the applicator body or insert. Sheaves (55-57) may be comprised of any suitable material, for example a polymeric material such as NYLATRON™ or NYLON™, or metal, and preferably rotate to help distribute the application force within the helical tension spring. Guide blocks may be comprised of any material, or lubricant impregnated material having a low coefficient of friction. Guide blocks, or sheaves 55-57 may be mounted to the dispensing insert or applicator body in any appropriate manner, for example sheaves may be mounted using cylindrically shaped standoffs or bushings (65-67). Winding of the spring 45 around the guide blocks or sheaves 55-57 allows for enough spring extension to provide the required application force.

The insert cover 15 shields the spring mechanism 40 and may assist in preventing axial movement of the guide blocks or sheaves 55-57. The spring mechanism 40 may be held in position by fasteners 25-28, that fasten the insert cover 15 to the mounting plate 20 and pass though standoffs 54, 65-57. A similar construction may be used if the insert cover is attached to an applicator body as a unitary design. The fasteners used may be of any type of fasteners known in the art, for example but not limited to, screws, bolts, pins or rivets. Each of the fasteners 25-27 passes through an aperture 35 in the insert cover 15, through standoffs 54, 65-67, and into the mounting plate 20. In this manner the fasteners 25-27 may maintain guide blocks or sheaves 55-57, and the vertical portion 54 of the fixed spring anchor 50, in a fixed position. However, other methods for attaching the dispensing insert 10 to the applicator body 4 may also be used as would be evident to one of skill in the art. For example flexible tabs extending from the dispensing insert and that pass through corresponding openings in the applicator body 4, and that are bent over when the two components are attached together may be used, or the insert may be welded, or spot welded to the applicator body. With these alternate methods of fastening, the sheaves may be placed onto, and rotate around pins that may be formed or inserted within, the dispensing insert 10 or applicator body 4.

The first end of the helical spring, the second end of the helical spring, an intermediate location between the first and second ends of the helical spring, or an extension attached to the first or second end, or an intermediate location of the helical spring is attached to a floating spring mount 60 positioned within the dispensing insert 10 or body 4. The floating spring mount 60 is free to travel along the mounting plate 20 via a slot 22 that is located within the mounting plate. Disk 70 may be placed between the spring mount 60 and the mounting plate 20 (see FIG. 2*h*). A second disk 75, placed on the opposite side of the mounting plate 20, is attached to spring mount 60, for example by washer 80 and fastener 85. The bottom (second) disc may be made of any suitable material, and be of any configuration that can abut and push a solid composition stick. The spring mount 60, second disc 75, or both the spring mount 60 and second disc 75, may comprise the pushing assembly. An assembled dispensing insert 10, comprising the above elements, is shown in FIG. 2*c*.

Figure 2H:
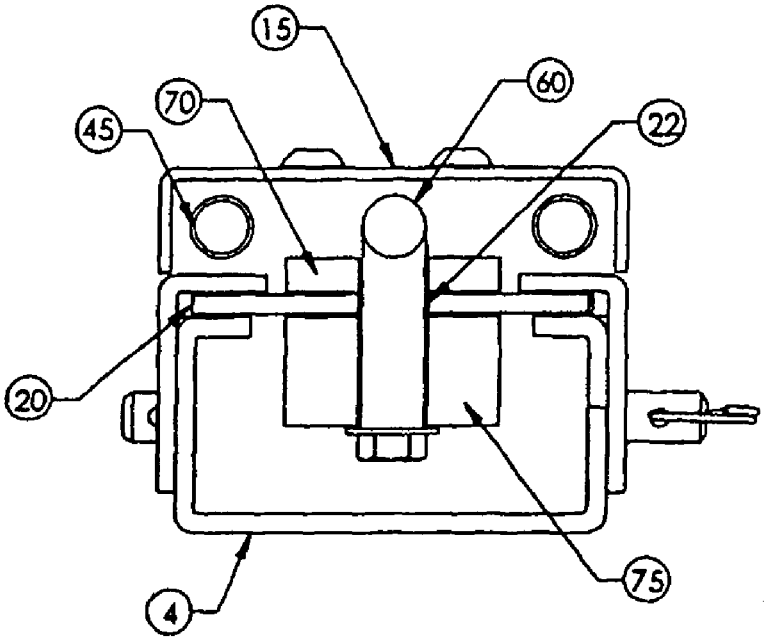
FIG. 2*h* shows a cross section of an applicator comprising a dispensing insert inserted within an applicator body.
Figure 3A:
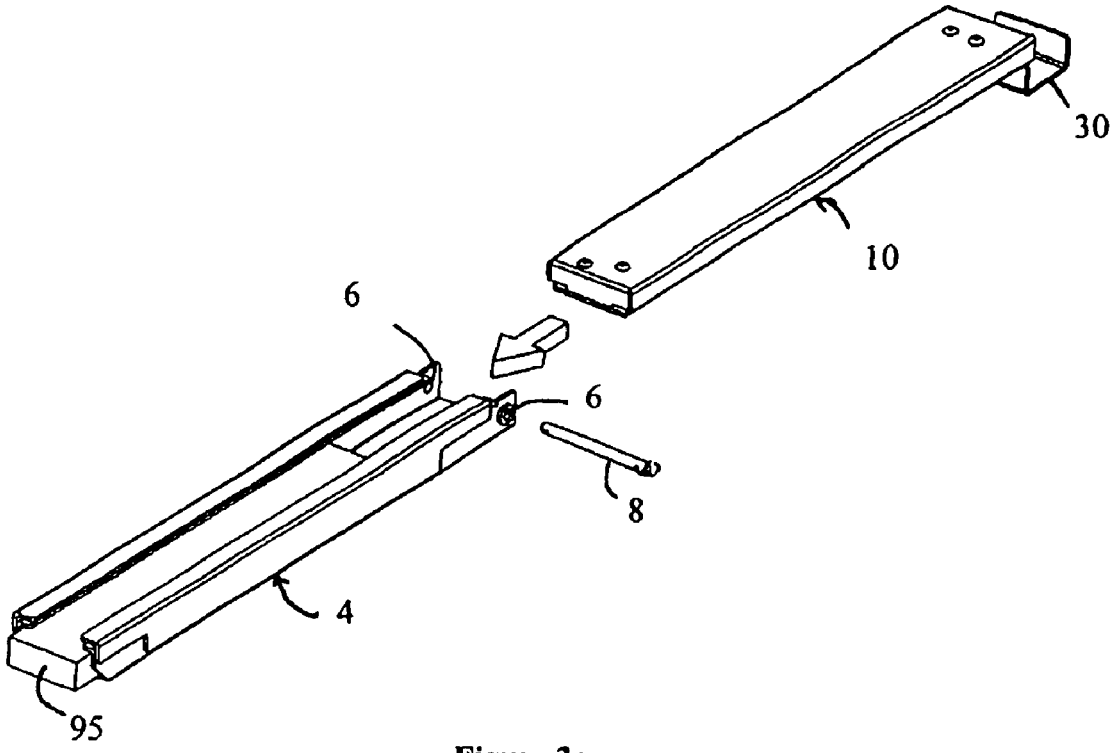
FIG. 3*a* shows a perspective view of a dispensing insert 10 and an applicator body 4 that comprises a composition stick 95. The arrow indicates the direction that the dispensing insert may be inserted into the applicator body.
Figure 3B:
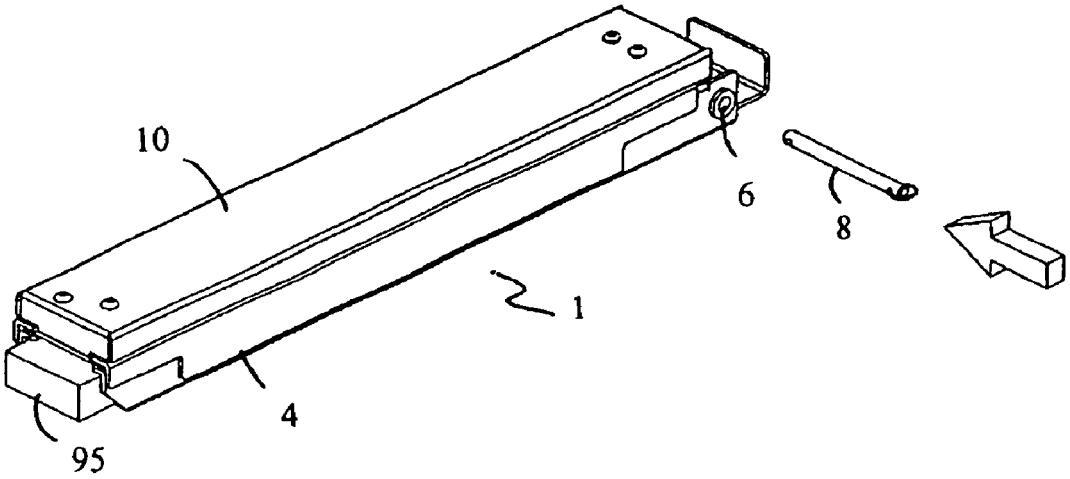
FIG. 3*b* shows a perspective view of the assembled applicator of FIG. 3*a*.

The assembled dispensing insert 10 may be inserted into the applicator body 4 as shown in FIG. 2*d*, where lip 17 (FIG. 2*c*) is registered within groove 5 (FIG. 2*a*). A cross section of an assembled applicator is shown in FIG. 2*h*. FIG. 3*a* shows a solid composition stick 95 loaded within the applicator body 4. The dispensing insert 10 may then be fastened to the applicator body 4 using pin 8. In the example shown in FIGS. 3*a* and 3*b*, pin 8 passes within hold 30, of the dispensing insert 10, and abuts a surface of the hold, to prevent the insert from sliding out of the applicator body 4. However, any suitable retainer for example a clip or snap (not shown) may also be slid around the back of the dispensing insert 10 and hold the insert in place within the applicator body 4. The dispensing insert 10 may be sold separately from the applicator body 4, and if desired may be disposable. In this case, the materials used in the construction of the dispensing insert may be less robust than those utilized to construct a permanent dispensing insert.

As the dispensing insert 10 is pushed into the applicator body 4, the composition stick 95 abuts the second (bottom) disk 75 of the pushing assembly, which extends the helical tension spring 45. By inserting the dispensing insert 10 within the applicator body, the extended helical spring 45 creates a force urging the pushing assembly against composition stick 95, which in turn urges stick 95 out of the holder. When the applicator is mounted adjacent a surface to be treated, and loaded as described above, the bottom disc, attached to the extended spring, abuts and forces the composition stick 95 out of the applicator and against the surface.

As one of skill in the art readily appreciates, the dispensing insert 10 may be fastened to the applicator body 4 in a more permanent manner if desired, for example by rivets, flexible tabs, bolts, or welding. In this case, the helical tension spring is extended by inserting a composition stick within the aperture of the applicator body so that it abuts the bottom disc and then, pushing the stick into the applicator body. To assist in loading, the applicator may be pivotally mounted adjacent the surface to be treated and move into a position permitting the introduction of the composition stick within the applicator, and moved back into an operative position.

With reference to FIGS. 2*e*, 2*f*, 2*i*, 4*a* and 4*b*, an alternate applicator is shown wherein the top, or outer plate of the applicator is the cover (15), and functions in a manner analogous to the insert cover 15 described above, wherein the spring assembly, guide system, and pushing assemblies may be mounted on the top plate. The top plate 15 may also guide the movement of the pushing assembly along slot 22. However, the spring assembly, guide system and pushing assemblies may also be mounted within the applicator body (4; bottom housing), and both the top plate and the top surface of the applicator body comprise a slot 22 for guiding movement of the pushing assembly. The top plate is typically attached to the bottom housing 4 to form the applicator 1, and the top plate may, or may not, be removable.

Slot 22, provided within the mounting plate and the top surface of the applicator body, registers with a first extension (floating spring mount) 60 of the disc 70 of the pushing assembly, so as to guide the movement of the bottom disc within applicator 1. The slot 22 may be covered in any suitable manner to permit movement of the bottom disc, yet reduce entry of dirt into the applicator body, for example both sides of slot 22 may be lined with a flexible brush, or a flexible covering, for example a rubberized covering, may be attached to each side of slot 22.

Figure 2I:
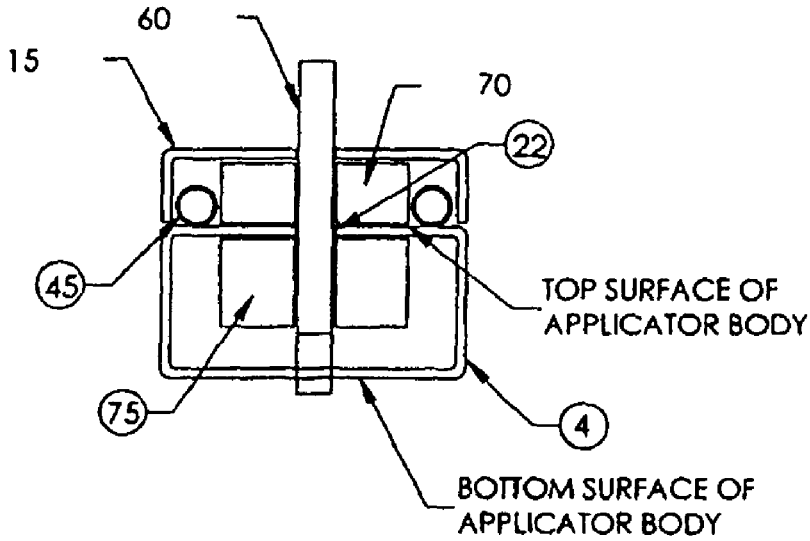
FIG. 2*i* shows a cross section of an alternate applicator comprising a top plate coupled with an applicator body.
Figure 4A:
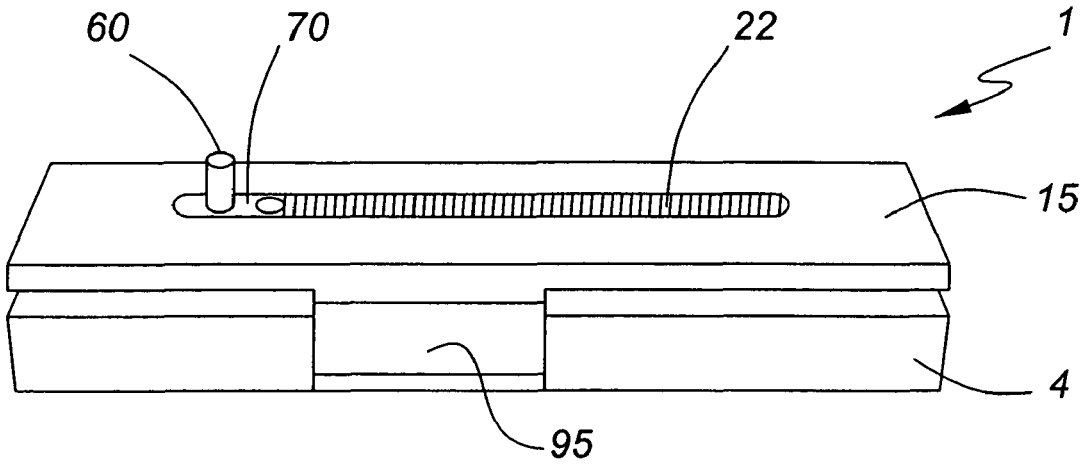
FIG. 4*a* shows a perspective side view of an alternate applicator of the present invention. The helical tension spring is pulled to one end of the applicator body, extending the spring and permitting a composition stick 95 to be inserted within the applicator.
Figure 4B:
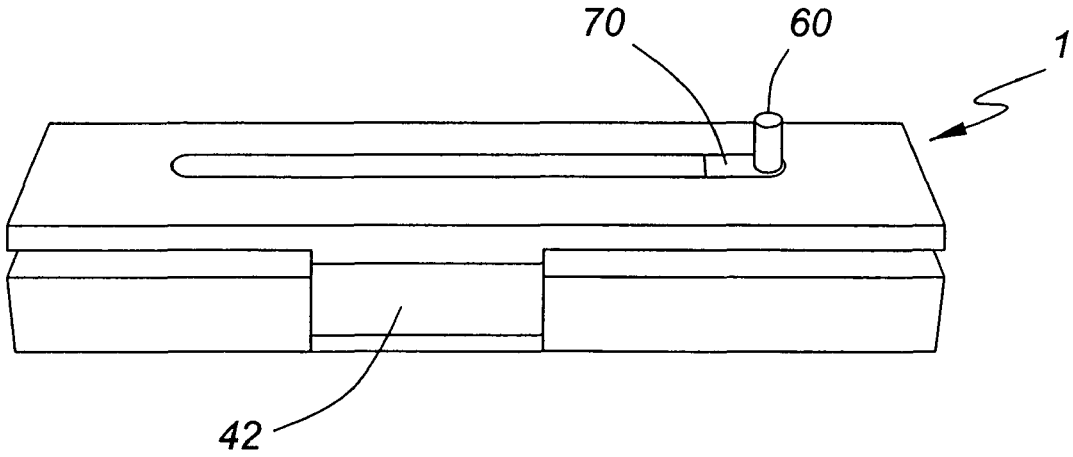
FIG. 4*b* shows a perspective side view of the alternate applicator of FIG. 4*a* showing a receiving slot 42 through which a composition stick may be inserted within the applicator.

The first extension 60 of the pushing assembly may also extend out from the bottom surface of the applicator body, or the surface of the top plate as shown in FIGS. 2*i*, 4*a* and 4*b*. The floating spring mount 60 may be used to move the disc 70 within applicator 1, when assembled, to facilitate loading of the applicator with composition sticks 95 (see FIGS. 2*e*, 2*f*, 2*i*, 4*a* and 4*b*). The floating spring mount 60 may also be coupled with a bottom floating disc 75 of the pushing assembly. The bottom floating disc 75 is positioned within the applicator, and contacts a composition stick when the stick is loaded within the applicator 1. The spring mount 60 (first extension) is fixed to a second end of a helical tension spring 45, or an extension of the helical tension spring. The first end of the helical tension spring 45 may be attached to the mounting plate 20 or the applicator body 4. The helical tension spring 45 is wound around a sheave system of two or more than two sheaves 55 as described above.

Assembly of the insert cover (top plate) 15 to the bottom housing (applicator body 4) produces an applicator 1 having a cavity that houses the pushing assembly (disc 70), helical tension spring 45, sheave or guide system (e.g. 55). One end of applicator 1 is open so that a composition stick may be inserted into, and pushed out of, the applicator. In an alternate configuration, the applicator 1 may comprise a receiving slot 42 sized to accept a composition stick 95 that is to be loaded within the applicator. The receiving slot may comprise a sliding door, a brush boarder, or a flexible covering, to reduce entry of dirt within the cavity of applicator.

With reference to FIGS. 4*a* and 4*b*, loading applicator 1 involves sliding the first extension 60 of the disc 70 along slot 22 and extending the helical tension spring 45. When the bottom disc is clear of the receiving slot 42, then one or more than one composition stick 95 may be inserted within the cavity of the applicator, and the spring released so that a positive force is applied against the composition stick to push it out of the opening at the end of the applicator. The applicator 1 may be mounted in a desired location adjacent a surface to be treated, in a similar manner as described earlier. An applicator with a receiving slot 42 does not require open space behind the applicator for removing or inserting a dispensing body, nor does it require a pivoting mount to swing the applicator away from the surface to be treated for front-loading the applicator, and may be used in applications with limited space.

From the fully loaded position, the applicator of the present invention provides a average spring force over the life of the solid lubricant stick of any desired amount which can vary depending upon the properties of the tension helical spring. For example which is not to be considered limiting, one helical spring assembly of the present invention provided a start force of about 7.4 lbs, and an end force of about 4.5 lbs, of the composition stick against a surface. The average spring force over the life of the solid lubricant stick is about 6.0 lbs. The spring provided a force gradient of 0.182 lb/in when extended. The spring's manufactured length or wire diameter may be changed to increase or decrease the overall application force. As the length of the spring (in its relaxed state) is increased, for a given applicator length and arrangement, the spring's overall application force is reduced. Conversely, to increase the application force, the manufactured length of the spring may be reduced and an extension to the helical spring (either polymeric or metallic cable) may be added as noted above.

In one example, which is not to be considered limiting, the helical tension spring has a force gradient of 0.182 lbs/in. The spring is wound through a series of sheaves to allow for enough spring extension to provide the required application force. The tension spring has an outside diameter of 0.50"+/−0.009" and a wire diameter of 0.048", and a relaxed length of 19".

The use of an applicator comprising a tension spring-sheave system as described herein results in a longer life characterized as having a cyclic life higher than about 250,000 cycles. When used in rail applications, the applicator of the present invention may have a field life of over three years. This is in contrast to coiled spring constant force spring (CFS) based applicators that are characterized as having a cyclic life of 8,000-20,000 cycles and a field life of less than one year. Furthermore, the applicator of the present invention may be used in freight locomotive environments exposed to harsh vibration and shock, dust, dirt, and oily conditions as well as extreme temperatures.

The Applicator of the present invention may also be configured to permit reloading of composition sticks in the absence of tools. This may be done using an applicator that does not comprise an insert, which removes the need for fasteners or pins to retain the insert within the applicator body. With standard applicators twice the length of the applicator is required for removing the insert from the applicator body, or for inserting a composition stick within the applicator from one end of the applicator. In an embodiment of the present invention, the applicator body 4 and insert 10 are of a unitary design and the composition sticks can be loaded within the side (see FIG. 4*a*) or rear of the applicator. This permits the use of a longer applicator with the space envelope with which the applicator is mounted, and provides a longer service interval.

The present invention has been described with regard to one or more embodiments. However, it will be apparent to persons skilled in the art that a number of variations and modifications can be made without departing from the scope of the invention as defined in the claims.

EXAMPLES

Figure 5A:
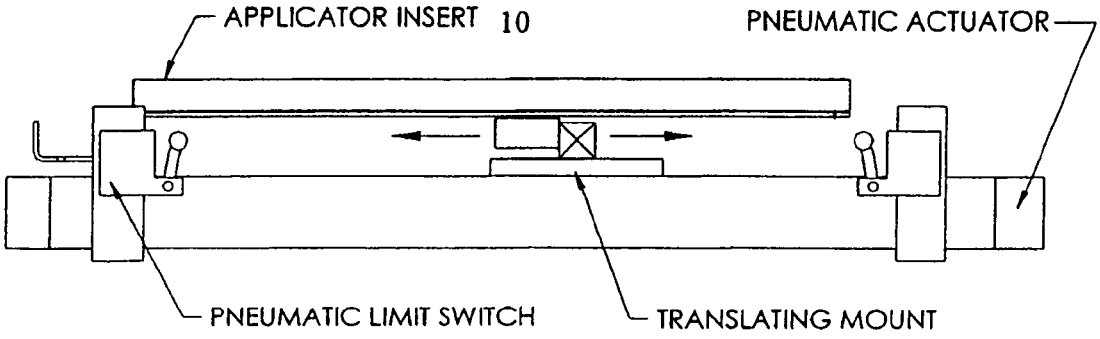
FIG. 5*a* shows a side view of the apparatus.
Figure 5B:
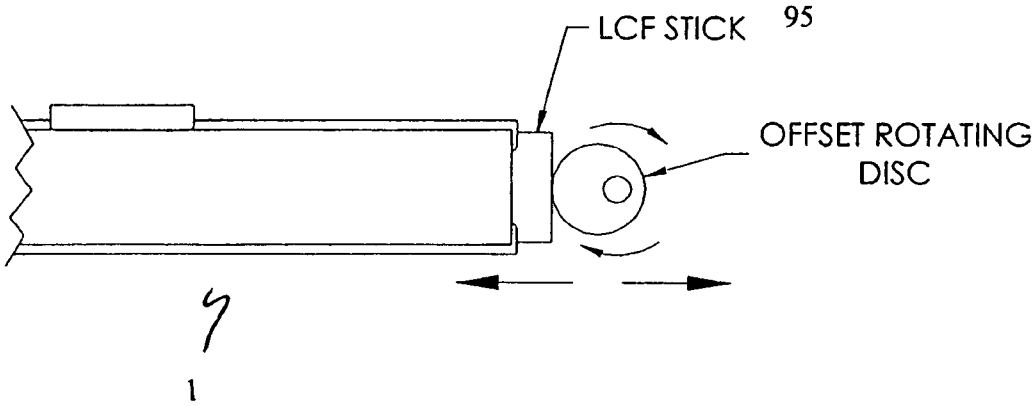
FIG. 5*b* shows a top view of a portion of the apparatus.

The applicators comprising prior art constant force springs, and helical tension springs of the present invention were tested to determine reliability and performance. A spring extension test rig (SETR; FIG. 5*a*) and a rotating cam test rig (RCTR; FIG. 5*b*) were used to simulate service conditions.

As described in more detail below, test results show that, compared to a prior art applicators comprising constant force springs, for example as disclosed in U.S. 2003/0,101,897; U.S. Pat. No. 5,251,724 or U.S. Pat. No. 5,337,860, the applicator and helical tension spring of the present invention exhibit substantially greater spring life. The applicator and spring assembly of the present invention provides between 19 and 46 times greater service life that an applicator comprising a CFS, when tested under the conditions. After each test, the applicator was disassembled and the moving parts examined. Wear and service life is recorded for each part. It was found that the present applicator functions well in extremely contaminated conditions and is unaffected by extreme vibration and impact.

CFS Applicator

An applicator insert, as described in U.S. Publication No. 20030101897, comprising a formed steel plate; and a constant force spring (CFS; see FIG. 4) was used for this analysis. The CFS has an extension length of 26" and generates 6 lbs+/−0.5 lbs application force. The spring is made from 1.5"×0.010" stainless spring steel (available from Vulcan Springs; part number K9S26KE). The initial inside diameter and outside diameter are 0.85" and 1.0" respectively. The box like end allows the spring to be clipped onto a narrow slot cut at one end of the ⅛" formed steel insert plate. The applicator is a formed sheet steel weldment with overall dimensions of 21.5"×3.2"×1.8". The applicator has a ⅛" groove on both sides along the length to allow for insert placement. The insert is housed in the applicator, which directs the solid lubricant stick toward the wheel flange. A ⅜" ball-lock pin is forced through two concentric holes on either side of the applicator back end of the applicator to fix the insert into position within the applicator.

Test Equipment:

The Spring Extension Test Rig (SETR; FIG. 5*a*) is used to simulate service conditions. The SETR simulates continuous stick consumption and reloading. An actuator drives a translating mount along the apparatus, and two strategically placed limit switches produce continuous back and forth motion of the translating mount. Loading and consumption of the applicator and the effects of these activities on the spring assembly is simulated by repeatedly extending and retracting the spring (either a constant force spring or a helical tension spring). The spring is extended and retracted by abutting the spring against the translating mount, and having the translating mount move between the two limit switches. One complete stick consumption/reloading cycle takes 2.1 seconds.

A Rotating Cam Test Rig (RCTR) is used to simulate continuous shock loading (See FIG. 5*b*). A 120 Volt AC electric motor, drive belt, and a gear reducer provide the rotary motion for the cam. The applicator and drive system are fixed in place by a rigid metal stand. To test the applicator inserts, the dispensing insert is slid into position within the applicator body loaded with a composition stick, and fixed in place by a lock pin. The composition stick is forced against the cam by the spring assembly (either a constant force spring or a helical tension spring) and the electric drive is switched on, causing the cam to rotate. Rotary motion is translated into reciprocative motion as the composition stick follows the eccentric path of the cam. The RCTR provides continuous shock loading at a frequency of 9.7 hertz.

Test Procedure

Several tests are conducted to simulate freight locomotive service. The RCTR and SETR are used to simulate the following:

Cyclical Dynamic Loading

Stick Consumption and Reloading

Environmental Contamination

Each insert test is described by the following:

1) Cyclical Dynamic Loading (RCTR):

4.0" composition stick, Non-contaminated 14.5" composition stick, Non-contaminated 14.5" composition stick, Contaminated 2) Loading Simulation (SETR):

Non-contaminated

Figure 6:
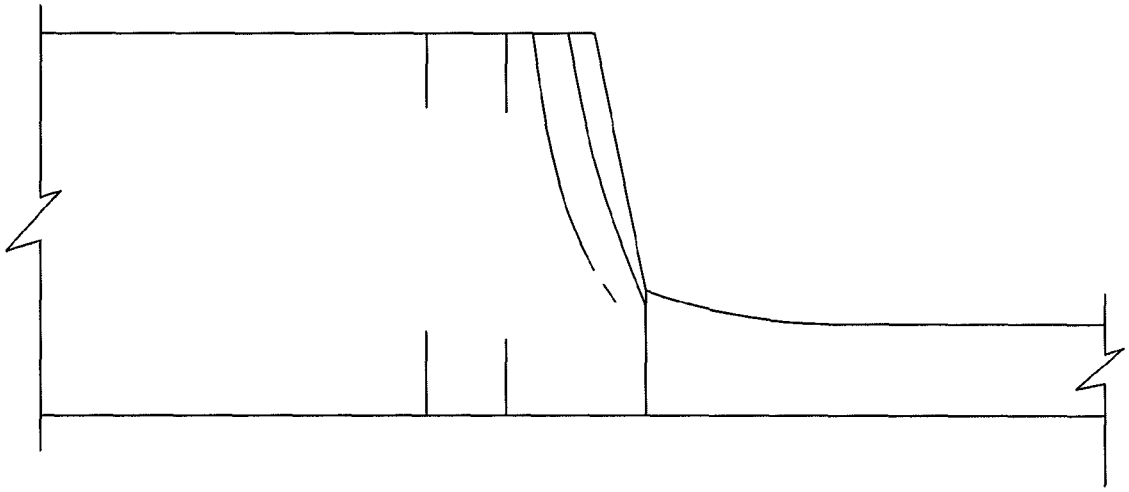
FIG. 6 is a photograph of a used, damaged constant force spring.

A 4" and 14.5" composition stick is cycled in the RCTR. The compositions of the sticks used for insert testing are defined in U.S. Pat. No. 5,173,204 or U.S. Pat. No. 5,308,516. Each stick has cross sectional dimensions of 1"×2.5". During the contamination test, each dispensing insert is submersed in a bath of water, sand, and silt. The mixture is agitated prior to submersion to ensure thorough contamination. This procedure is repeated at 30-40 minute intervals. During testing, each spring was examined for failure at 30 minute intervals. A CFS was considered failed when 75% of the cross section had been torn due to fatigue (FIG. 6).

Table 1, shown below, is a summary of the test results for the prior art applicator comprising a CFS, and the applicator of the present invention comprising a helical tension spring.

TABLE 1

RCTR (Rotating Cam Test Rig) and SETR (Spring Extension Test Rig) results
Summary (constant force spring: CFS; helical tension spring: HTS)

| | | Average Number of Cycles Until Failure | | | |
|---|---|---|---|---|---|
| | | CFS | | HTS | |
| No. | Description of Test | Average | Std. Dev | Average | Std. Dev |
| 1 | RCTR, Non-Contaminated, 4" stick | 80,500 | 14,021 | 1,629,000 | 227,400 |
| 2 | RCTR, Non-Contaminated, 14.5" stick | 51,600 | 11,227 | 2,400,200 | N/A* |
| 3 | RCTR, Contaminated, 14.5" stick | 101,500 | 23,215 | 1,929,400 | 628,000 |
| 4 | SETR, Non-Contaminated | 16,000 | 2,375 | 14,800 | 2,700 |

*Statistical Analysis is not done due to a low number of trials.

The results from the tests, shown in Table 1 indicate that the applicator of the present invention offers substantially greater spring life. In the RCTR tests using a 4" composition stick the applicator comprising a CFS lasts 80,500 cycles while an applicator comprising the HTS spring runs for 1,629,000 cycles, and lasts 20 times longer. Similar results were obtained using a 14.5" composition stick, where the average spring life for the CFS and HTS applicators is 51,600 cycles and 2,400,200 cycles, respectively. Under these test conditions, the applicator of the present invention (applicator comprising a HTS) lasts an average of 46 times longer than that of the prior art (applicator comprising a CFS). Under contaminated conditions, using a 14.5" composition stick applicator containing the CFS failed, on average, after 101,500 cycles. The applicator comprising the HTS lasted for an average of 1,929,400 cycles, which represents an increase in spring life over that of the prior art applicator by a factor of 19.

The SETR runs each insert until spring failure occurs. The applicators containing a CFS or an HTS failed after 16,000 cycles and 14,800 cycles, respectively. Taking into consideration the corresponding standard deviations, these results may be considered equal. At this rate, the applicator of the present invention could be refilled daily for about 40 years before failure occurs.

The tests performed on the applicator of the present invention comprising a HTS and the prior art applicator comprising a CFS demonstrate that:

The applicator of the present invention lasts, on average, 20 times longer than the prior art applicator in a non-contaminated environment when a 4" composition stick is cycled.

The applicator of the present invention lasts, on average, 46 times longer than the prior art applicator when a 14.5" composition stick is cycled in a non-contaminated environment.

The applicator of the present invention lasts, on average, 19 times longer than the prior art applicator when a 14.5" composition stick is cycled in a contaminated environment.

In consumption/reloading tests, each of the CFS and HTS lasts an equal number of cycles until spring failure.

The applicator of the present invention functions well in extremely contaminated conditions involving water, silt, and sand.

The applicator of the present invention is resistant to extreme vibration and impact.

All references and citations are herein incorporated by reference.

The embodiments of the invention in which an exclusive property of privilege is claimed are defined as follows:

1. A solid composition stick applicator comprising, a) an applicator body comprising a cavity having a longitudinal axis for housing a solid composition stick, the applicator body having a first and second end, the second end comprising an opening coaxial with and disposed along the longitudinal axis of the cavity through which the solid composition stick is dispensed, the opening at the second end, an opening at the first end, or an aperture in the side of the applicator body being sized to receive the solid composition stick for inserting the solid composition stick into the cavity;

b) a helical tension spring having a first spring end and a second spring end, the first spring end, the second spring end, or both the first spring end and the second spring end held at a fixed position with respect to the applicator body;

c) a guide system within the applicator body, the guide system comprising one or more than one rotating guide block or sheave around which the helical tension spring is passed to redirect a path of the helical tension spring; and d) a pushing assembly attached to the helical tension spring and extending into the cavity, the pushing assembly being movable from a first position proximate the first end of the applicator body, to a second position proximate the second end of the applicator body, where tension within the helical tension spring is greater in the first position than in the second position thereby urging the pushing assembly towards the second end of the applicator body.

2. The solid composition stick applicator of claim 1 further comprising a mount attached to the applicator body, the mount for attaching the solid composition applicator adjacent a surface to be treated.

3. The solid composition stick applicator of claim 2, wherein the mount is pivotally attached adjacent the surface to be treated.

4. The solid composition stick applicator of claim 1, wherein the helical tension spring further comprises an extension of the helical tension spring attached to the first spring end, the second spring end, or both the first and second spring ends.

5. The solid composition stick applicator of claim 1, wherein the guide system comprises 1, 2 or 3 sheaves.

6. The solid composition stick applicator of claim 1, wherein the helical tension spring, the pushing assembly and the guide system are part of a dispensing insert that attaches to the applicator body.

7. The solid composition stick applicator of claim 6, wherein the dispensing insert is removably attached to the applicator body.

8. The solid composition stick applicator of claim 1, wherein the helical tension spring, the pushing assembly and the guide system are part of the applicator body.

9. The solid composition stick applicator of claim 1, wherein movement of the pushing assembly from the first position to the second position is guided by a slot through which the pushing assembly, or a portion of the pushing assembly passes.

10. A solid composition stick applicator comprising:

a) an applicator body comprising a cavity having a longitudinal axis for housing one or more solid composition sticks, the applicator body having a first end and a second end, the second end comprising an opening coaxial with and disposed along the longitudinal axis of the cavity through which the solid composition stick is dispensed; and b) a dispensing insert for applying pressure to the solid composition stick housed in the applicator body such that the stick is dispensed from the second end of the applicator body, the dispensing insert including:

i) an insert body;

ii) a helical tension spring having a first end and a second end, the first end, the second end, or both the first and second end attached to the insert body at a fixed position;

iii) a pushing assembly attached to the helical tension spring; and iv) a guide system within the dispensing insert, the guide system comprising one or more than one rotating guide block or sheave around which the helical tension spring is passed to redirect a path of the helical tension spring to create a force urging the pushing assembly against the solid composition stick, which urges the solid composition stick against the surface to be treated.

11. The solid composition stick applicator of claim 10, wherein the dispensing insert removably matingly engages the applicator body.

* * * * *